US006382814B1

(12) United States Patent
Petrocelli

(10) Patent No.: US 6,382,814 B1
(45) Date of Patent: May 7, 2002

(54) ORNAMENTAL LIGHT DISPLAY SIMULATING FALLING SNOW

(76) Inventor: Daniel W. Petrocelli, 143 Albermarle Ave., Valley Stream, NY (US) 11580-2718

( * ) Notice: Subject to any disclaimer, the term of this patent is extended or adjusted under 35 U.S.C. 154(b) by 0 days.

(21) Appl. No.: 09/570,713

(22) Filed: May 15, 2000

(51) Int. Cl.[7] ..... F21S 13/14

(52) U.S. Cl. ..... 362/252; 362/227; 362/236; 362/251; 40/410; 40/427; 40/442; 40/444

(58) Field of Search ..... 362/121, 227, 362/252, 249, 806, 807, 145, 147, 235, 236, 251, 808, 810, 811; 40/410, 427, 442, 444

(56) References Cited

U.S. PATENT DOCUMENTS

| | | | | |
|---|---|---|---|---|
| 3,619,598 A | * | 11/1971 | Hermanson | 362/122 |
| 3,789,211 A | | 1/1974 | Kramer | |
| 3,816,739 A | | 6/1974 | Stolov | |
| 4,713,586 A | * | 12/1987 | Chiang | 315/200 A |
| 5,150,964 A | | 9/1992 | Tsui Pui-Hing | |
| 5,245,519 A | | 9/1993 | Openiano | |
| 5,632,550 A | | 5/1997 | Yeh | 362/123 |
| 5,669,707 A | | 9/1997 | Huang | 362/249 |
| 5,747,940 A | | 5/1998 | Openiano | 315/185 S |
| 5,828,183 A | | 10/1998 | Wang et al. | 315/185 S |
| 5,854,541 A | | 12/1998 | Chou | 315/185 R |
| 5,944,408 A | * | 8/1999 | Tong et al. | 362/252 |
| 5,967,644 A | | 10/1999 | Pan | 362/249 |
| 5,975,717 A | | 11/1999 | Rahman | 362/251 |
| 6,145,228 A | * | 11/2000 | LaChance | 362/441 |

FOREIGN PATENT DOCUMENTS

| | | |
|---|---|---|
| FR | 2 621 680 | 4/1989 |
| WO | WO 99/06759 | 9/1999 |

* cited by examiner

*Primary Examiner*—Sandra O'Shea
*Assistant Examiner*—Ismael Negron
(74) *Attorney, Agent, or Firm*—Collard & Roe, P.C.

(57) ABSTRACT

A decorative lighting display composed of ornaments, each having a form resembling a snowflake and illuminated by a light or lights. The illumination of the ornaments is sequenced by an electronic controller to create the illusion of falling snow when the display is mounted on a house, tree or other surface. The ornaments may be connected electrically by multi-conductor connectors which are wired in a configuration that maintains the proper sequence of ornament illumination as additional ornaments are added to the display. The controller has features that allow for adjustment of the sequencing rate and direction.

20 Claims, 6 Drawing Sheets

ORNAMENTAL LIGHT DISPLAY SIMULATING FALLING SNOW

BACKGROUND OF THE INVENTION

The invention relates to a snowflake display that comprises a series of frames having lights wherein the lights in these frames are turned on and off sequentially to give the appearance of falling snow.

SUMMARY OF THE INVENTION

A snowflake display has been provided wherein this display comprises at least one frame, at least one light disposed in this frame and at least one controller for alternately turning these lights on and off.

In one embodiment of the invention, the frame contains a plurality of branches and sub branches wherein these branches and sub branches are designed to make the frame have a snowflake appearance. These branches intersect in a center region on the frame and each branch contains at least one light.

In a first embodiment of the invention, the light is disposed outside of the frame. In a second embodiment of the invention, the frame is comprised of a clear or translucent plastic that lights up when a light positioned in a center region is turned on. In this case, the light is disposed within this frame so that when the light is turned on, the entire frame reflects light so that the entire frame is illuminated.

Finally, the controller comprises at least one timing and sequence control unit for controlling a time when the light will light, and an order when the light will light. In addition there is an output stage following this timing and sequence control unit that comprises a plurality of triac drivers for delivering electric power sufficient to illuminate the light(s) on this display. Because the lighting of the lights is being controlled by the timing and sequence control unit, each frame will light in an ordered sequence to give the appearance of falling snow on the side of a house or other vertical surface.

BRIEF DESCRIPTION OF THE DRAWINGS

FIG. 2(*b*), shows a side view of a light housed in the frame;

FIG. 3(*b*), shows a side view of a transverse extending sub-branch for the frame in FIG. 3(*a*);

FIG. 3(*c*), shows a cross sectional view of the frame in FIG. 3(*a*) with a light disposed therein;

DETAILED DESCRIPTION OF THE PREFERRED EMBODIMENT

Figure 1:
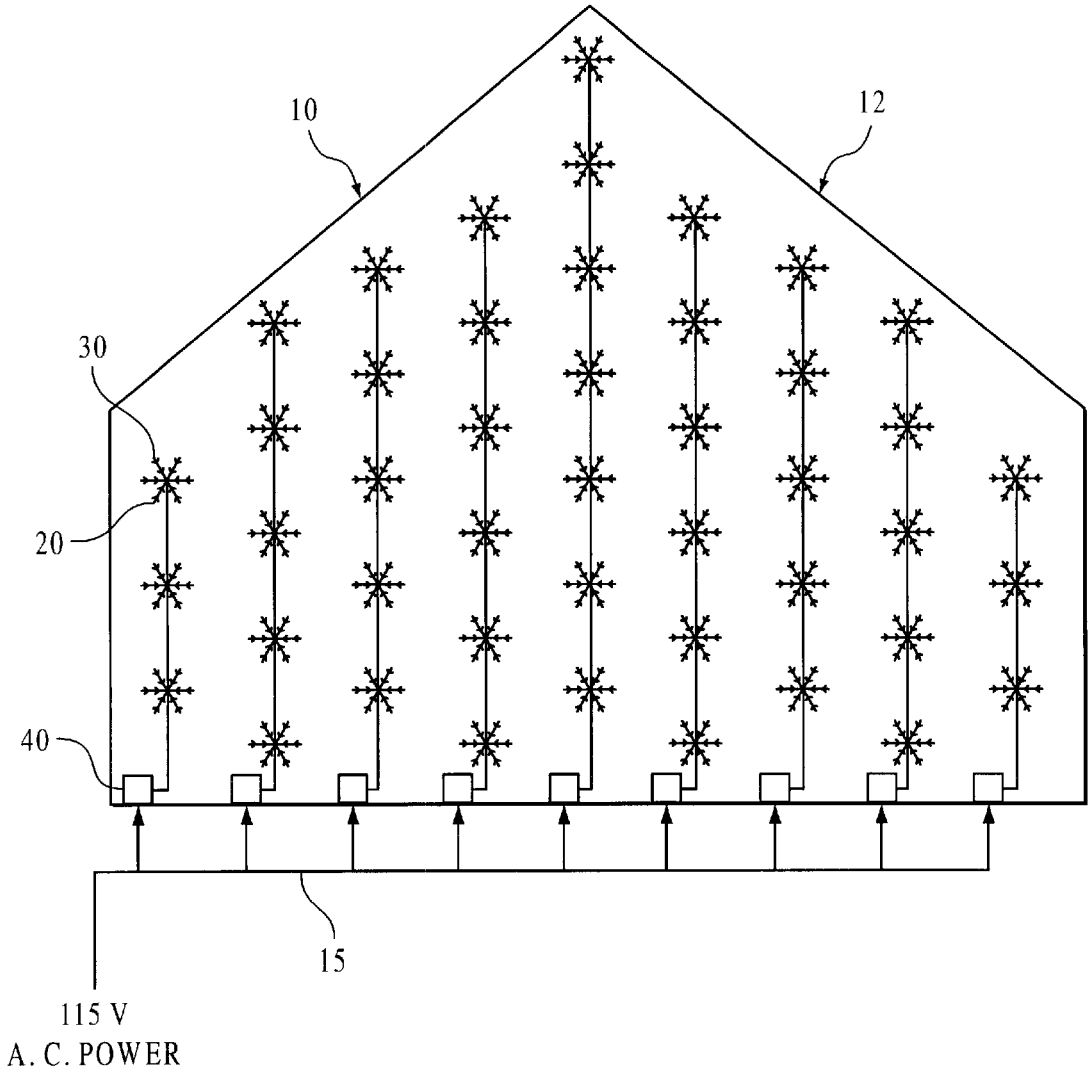
FIG. 1, shows a side view of the ornamental display on a side of a house.

Referring now in detail to the drawings and, in particular, FIG. 1 shows an ornamental display 10 displayed on the side of a house 12. The display comprises a series of frames 20, that each contain at least one light 30 that is controlled by a controller 40. Each controller 40 is supplied with 115 VAC via ordinary extension cords 15.

Figure 2A:
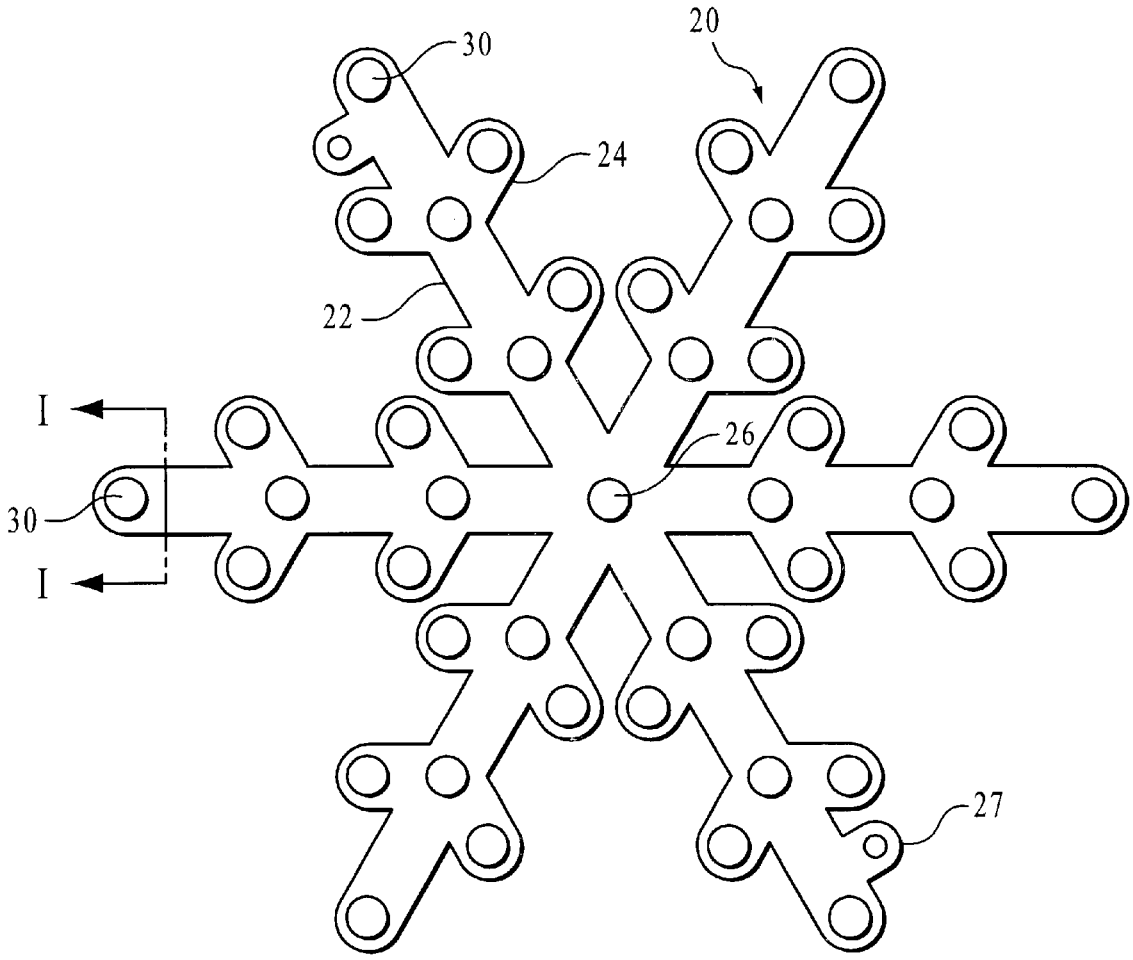
FIG. 2(*a*), shows a front view of a frame for the display.
Figure 2B:
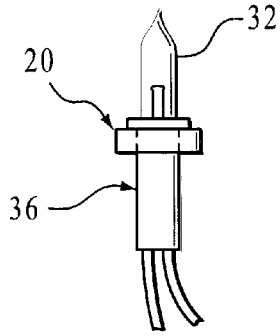

As shown in FIG. 2A, each frame 20 contains a plurality of branches 22 that each contain a series of sub-branches 24. This plurality of branches 22, meet in a center region 26 of frame 20. There is at least one light 30 disposed within frame 20 wherein light 30 could be an ordinary Christmas light that comprises a light unit 32 (FIG. 2B) and a socket 36 receiving light unit 32. In this first unit, this first embodiment of light 30 fits into frame 20 so that socket 36 resides inside of frame 20, while light 30 is exposed outside of frame 20. Mounting tabs 27 are provided to facilitate supporting the frame 20 on a side of a house with nails or other suitable fasteners.

Figure 3A:
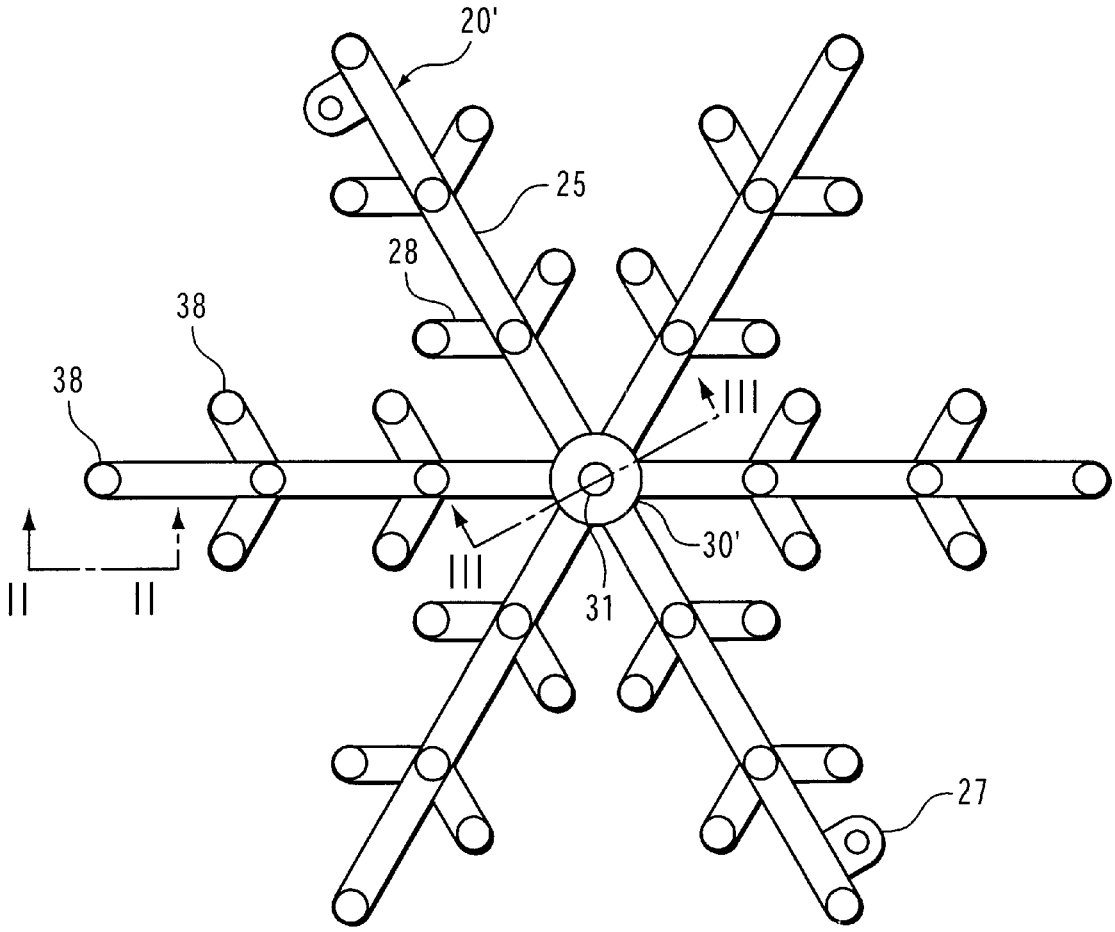
FIG. 3(*a*), shows a front view of a second embodiment of the frame for the display.
Figure 3B:
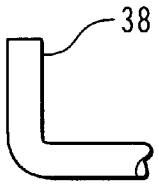
Figure 3C:
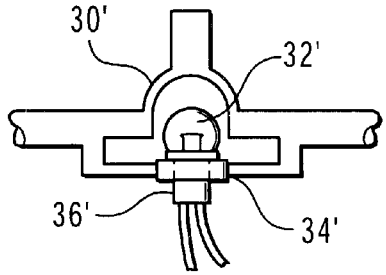

FIGS. 3A, 3B, and 3C disclose a second embodiment of the invention wherein frame 20' comprises a clear or translucent plastic injection-molded frame. In this embodiment frame 20' comprises a plurality of branches 25 and transverse sub-branches 28 that extend out of frame 20' to form a three-dimensional display. In this case, as shown in FIG. 3C, one light 30' is disposed inside of frame 20', wherein the light unit 32', light frame 34' and socket 36' are all disposed within frame 20' in the center region of the frame. Because frame 20' is formed as an injection molded clear or translucent plastic frame, this frame emits light at each branch termination 38 when light 30' is turned on in frame 20'. The frame is made from a light pipe or a material that functions as a conduit for light wherein this material extends out of the center region containing the light. In this way when light unit 32' lights in center region 31 it illuminates the entire frame.

Figure 4:
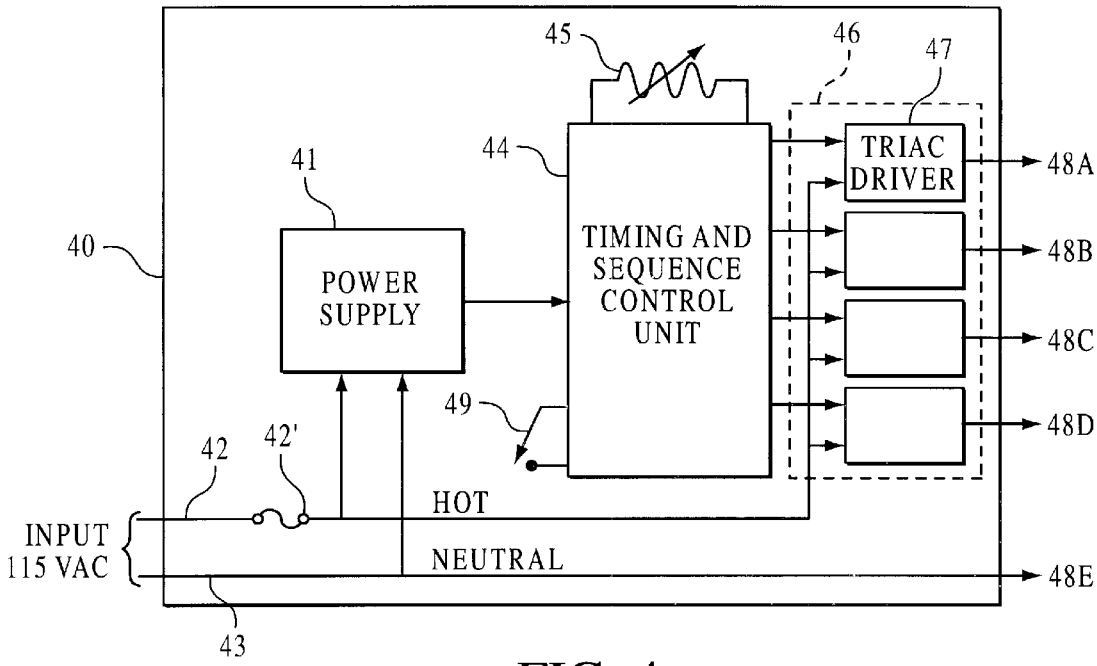
FIG. 4, shows a block diagram of a controller for controlling the display.

FIG. 4 discloses a block diagram of controller 40. Controller 40 comprises a power supply 41 that is fed by both a hot power line 42 and a neutral power line 43. Power supply 41 converts alternating current input power to direct current power required by the timing and sequence control unit 44. Timing and sequence control unit 44 feeds into an output stage 46 for lighting lights 30 or 30'. Output stage 46 comprises a plurality of triac drivers 47 forming a series of channels 48 communicating with lights 30 or 30' to alternately turn on and off lights 30 or 30'. These channels are designed so that only one of the channels is powered on at one time. If lights 30 or 30' are connected to a channel that is on, then that light is turned on, however if lights 30 or 30' are connected to a channel that is turned off, then that light is turned off. Timing and sequence control unit 44 alternately turns on and off channels 48 within the system based upon a timed sequence and an ordered sequence. Timing and sequence control unit 44 also controls the time rate or interval at which the output channels 48 are switched. This interval can be varied by the operator by adjustment of potentiometer 45. The ordered sequence is set so that each channel turns on and off in order, and then at each interval the display will change so that the channel will switch at each interval to a different channel. In a preferred embodiment, there are four separate channels 48A, 48B, 48C, and 48D wherein each channel switches on and off to alternately turn on and off lights 30 or 30' in frames 20 or 20'. Frames 20 or 20' each connect to an adjacent frame through a series of five pin connectors 50 and 50'. In such case that the operator desires to mount the controller 40 above the display, an external reversing switch 49 is provided on controller 40 to reverse the sequence of the output channels 48. This serves to maintain a top-to-bottom falling snow effect. For safety purposes, a current-limiting fuse 42' is installed in series with the AC hot power line 42.

Figure 5:
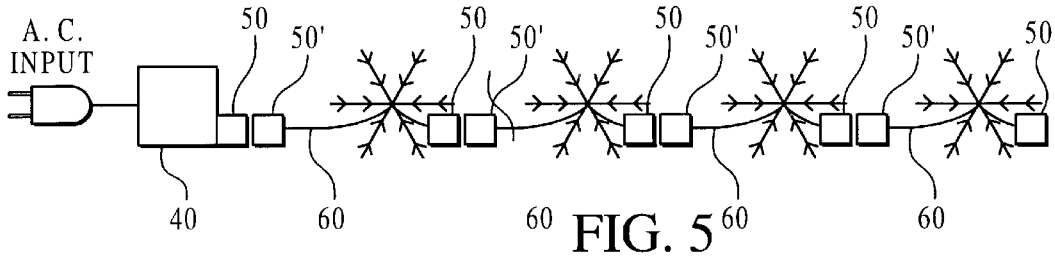
FIG. 5, shows a string wire configuration for a row of frames in the display.
Figure 6:
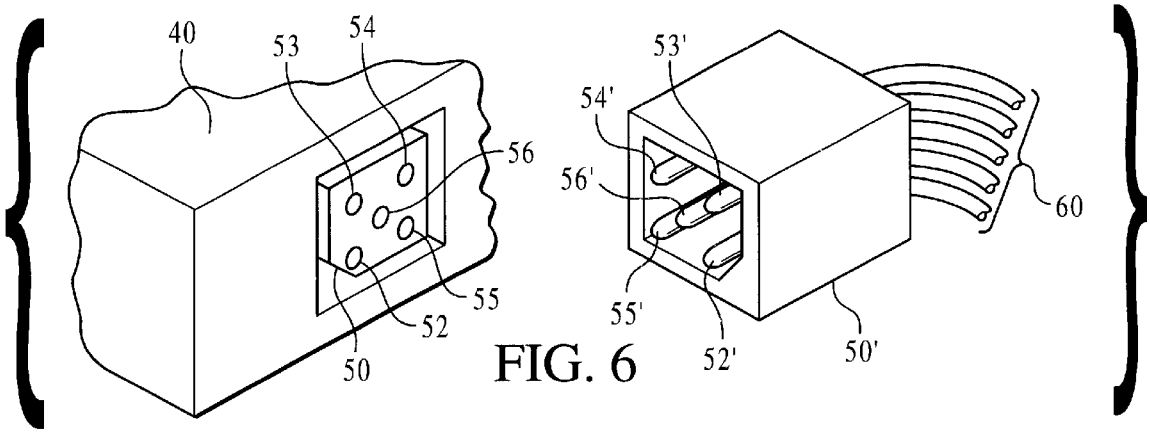
FIG. 6, shows a connection between a male and female connector for the display.

As shown in FIG. 6, female connector 50 comprises a plurality of receptacles 52, 53, 54, 55 and 56. Receptacles 52, 53, 54 and 55 are each set to send signals through different channels 48A, 48B, 48C, and 48D, based upon the instructions sent from controller 40. Receptacle 56 is neutral that is set to receive a neutral pin 56' that is common to all connections and is shown as channel 48E. Female connector 50 is disposed in controller 40 for feeding signals into male connector 50' on line 60. Line 60 is a wire harness composed of a series of wires that transmit power to lights 30 or 30' in frames 20 or 20'. These wires also transmit power to additional frames 20 or 20' by means of a female connector 50 at the opposite end of line 60. Thus, each frame 20 or 20' is wired to a wire harness line 60 that has a male connector 50' at one end and a female connector 50 at the opposite end as shown in FIG. 5.

Male connector 50' comprises a plurality of pins to connect to female connector 50 to form channels 48A, 48B, 48C, 48D and 48E. For example, male connector 50' comprises a first pin 52', a second pin 53', a third pin 54' and a fourth pin 55', all forming channels 48A, 48B, 48C and 48D shown in FIG. 4, while a fifth pin 56' is designed to receive a neutral feed 56' to form channel 48E.

In the preferred embodiment, both female connector 50 and male connector 50' are keyed so that they can only be mated with one orientation. This results in receptacles 52, 53, 54, 55 and 56 electrically connected to pins 52', 53', 54', 55' and 56' respectively when the connectors are mated.

The square shape of connectors 50 and 50' as shown in FIG. 6 is used for illustration purposes only as many other configurations would also be suitable.

Figure 7:
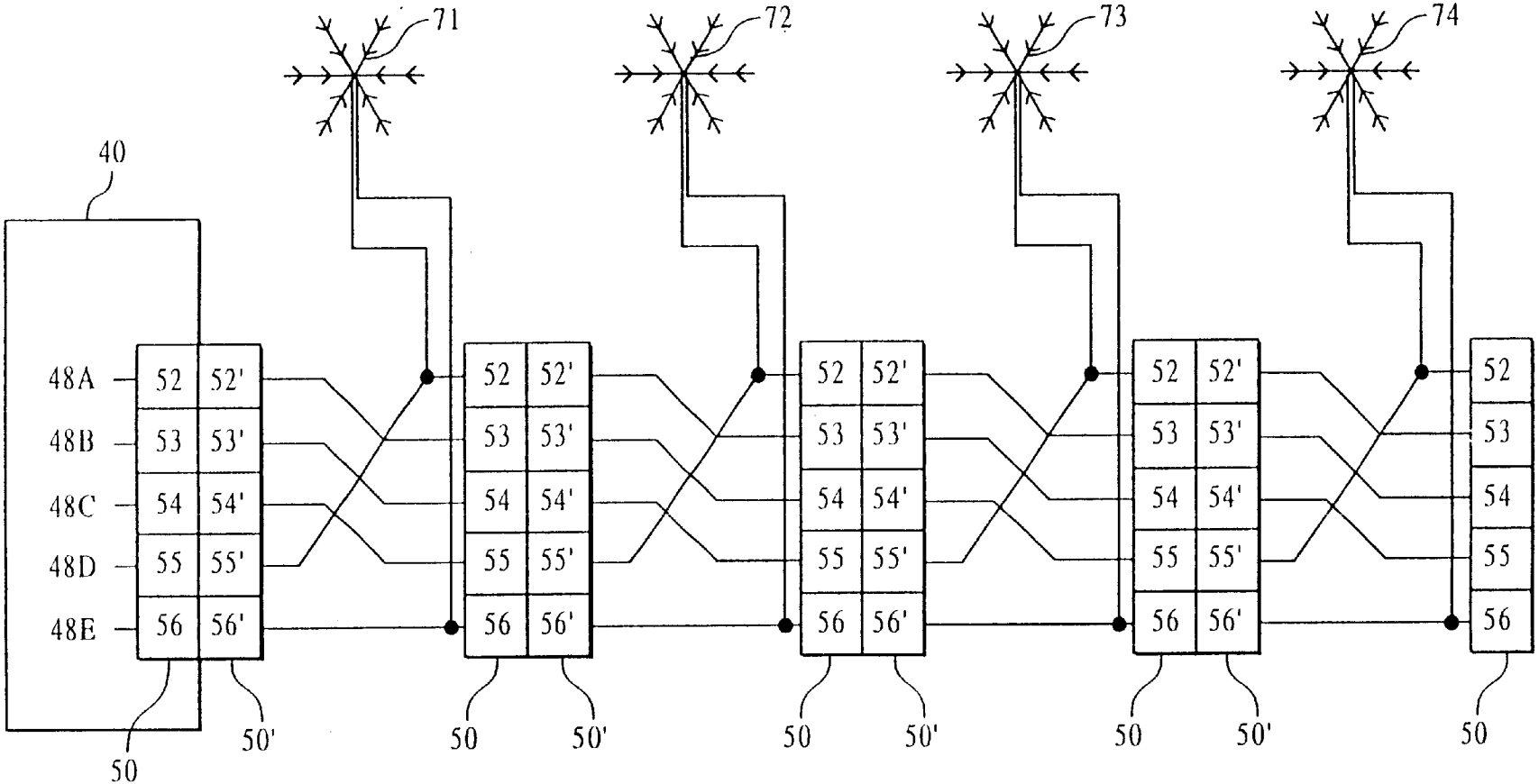
FIG. 7, shows a schematic diagram for the wiring of a series of frames in the display.

To create the effect of falling snow, each frame must alternately light in a timed pattern. To create this effect, a series of frames are connected together on different channels. This feature is shown in FIG. 7 wherein the schematic of the wire harness line 60, the receptacles of female connector 50 and the pins of male connector 50' are wired such that pin 52' is wired to receptacle 53, pin 53' is wired to receptacle 54, pin 54' is wired to receptacle 55, pin 55', is wired to receptacle 52, and pin 56' is wired to receptacle 56. The displays 71, 72, 73, and 74 are wired to receptacles 52 and 56 within their respective wire harness line 60. This skewing of channels as they propagate from male connector 50' to female connector 50 causes displays 71, 72, 73 and 74 to be electrically connected to channels 48D, 48C, 48B and 48A respectively. This results in the proper illumination sequencing of displays 71, 72, 73, and 74 from top to bottom. If it is desired to increase the length of the string by adding additional displays, their proper sequencing will be automatically maintained by merely plugging them into the end of the line, i.e., mating the new display's male connector 50' with the last female connector 50 on the string. Thus the only restriction on string length is the current-driving capacity of the triac drivers 47 (See FIG. 4) and wiring 60 which is limited by fuse 42' (See FIG. 4). This permits flexibility when installing the display on the side of a house where varying string lengths are desirable as shown in FIG. 1.

Thus, displays 71, 72, 73, and 74 alternately turn on and off to form a sequenced pattern when controller 40 alternately switches through channels 48A, 48B, 48C and 48D, formed by the connection between receptacles 52, 53, 54, and 55 in female connector 50 and pins 52', 53', 54' and 55' in male connector 50'. The switching occurs in a timed sequence through channels 48A, 48B, 48C, and 48D to give a viewer the perception of falling snow when these displays are alternately lighting on and off. This row can be repeated to an infinite number of displays wherein these four channels can be repeated throughout the display, with each section of display proceeding in a continuous sequence.

Figure 8:
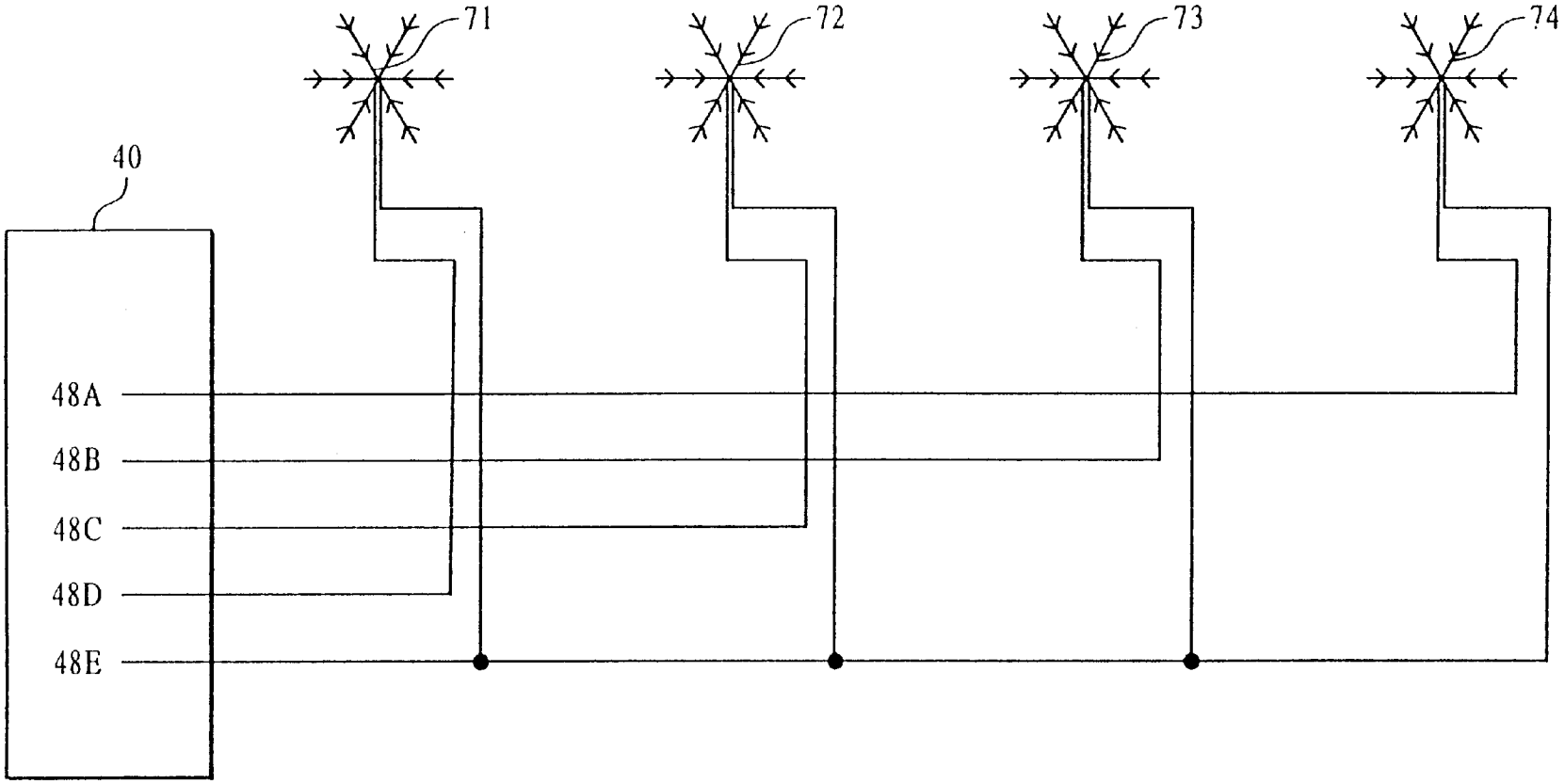
FIG. 8 is a schematic diagram for the second embodiment of the wiring of the invention.

FIG. 8 shows another embodiment of the present invention, wherein the system of interconnections between displays 71 thru 74 and the controller 40 using connectors 50 and 50' can be substituted with hard wiring between the aforementioned components. The result would be a light string fabricated to a fixed length, i.e. four displays. This would eliminate the flexibility in selection of string length but would be less expensive to manufacture.

In this case, channels 48A, 48B, 48C, 48D and neutral channel 48E are all hard wired so that channel 48D would light display 71, channel 48C would light display 72, channel 48B would light display 73 while channel 48A would light display 74. At the same time, each of the displays 71, 72, 73, and 74 are hard wired to neutral channel 48E. This design is important because it provides a less expensive less complicated solution than in the preferred embodiment. However, because in this design the displays 71, 72, 73, and 74 are all hardwired together, they are less adaptable than in the preferred embodiment.

Accordingly, while several embodiments of the present invention have been shown and described, it is to be understood that many changes and modifications may be made thereunto without departing from the spirit and scope of the invention as defined in the appended claims.

What is claimed is:

1. An ornamental display comprising:

(a) a plurality of snowflake-shaped frames;

(b) at least one light coupled to each of said frames, wherein said light, in combination with each of said plurality of snowflake-shaped frames, forms a snowflake shaped ornament; and (c) at least one controller;

wherein each of said plurality of frames are wired to adjacent frames in a multi-channel connection and wherein said controller controls the lighting of these frames so that said controller alternately turns on and off said at least one light within each of said plurality of frames to create a decorative pattern or display to produce an appearance of falling snow.

2. The display as in claim 1, wherein each of said frame is hard wired to an adjacent frame via a multi channel connection wherein said at least one controller switches channels to alternately light said at least one light in said frame and at least one light in said adjacent frame.

3. The ornamental display as in claim 1, wherein said at least one light is disposed in a center region on said frame and said at least one light comprises a light component, a light frame for holding the light component, and a socket for providing an electrical connection to said light component.

4. The ornamental display as in claim 3, wherein said socket is disposed within said at least one frame.

5. The ornamental display as in claim 1, wherein said frame comprises a plurality of branches.

6. The ornamental display as in claim 5, wherein said branches intersect in a center region on said frame.

7. The ornamental display as in claim 5, wherein each of said plurality of branches contains at least one of said at least one light.

8. The ornamental display as in claim 1, wherein said frame is comprised of a clear or translucent plastic.

9. The ornamental display as in claim 8, further comprising at least one transverse extending sub-branch extending out of at least one of said plurality of branches.

10. The ornamental display as in claim 8, wherein said at least one light is housed inside said at least one frame.

11. The ornamental display as in claim 10, wherein said at least one light is disposed within at least one frame below said at least one transverse sub-branch.

12. The ornamental display in claim 1, wherein said at least one controller comprises at least one power supply, at least one timing and sequence control unit, and at least one output stage for sending signals and power to said at least one light.

13. The ornamental display as in claim 12, wherein said at least one controller comprises at least one timing and sequence control unit for controlling a time when said at least one light will light, and an order when said at least one light will light.

14. The ornamental display as in claim 13, wherein said at least one output stage comprises a plurality of triac drivers for delivering electric power sufficient to illuminate said at least one light on said display.

15. The ornamental display as in claim 13, wherein said at least one output comprises a plurality of plug in connectors wherein each of said plurality connectors have a plurality of pins.

16. The ornamental display as in claim 15, wherein each of said plurality of plug in connectors comprises at least one male plug having five pins and at least one female plug containing five slots for receiving said pins.

17. The plug in connectors as in claim 16 wherein the wiring from female connector to male connector maintains proper channel connections as additional frames are added to the display to form a four channel sequence.

18. An ornamental display comprising:

(a) a plurality of snowflake-shaped frames wherein each frame comprises;

i) a central region i) a plurality of branches coupled to said central region;

ii) a plurality of sub-branches coupled to said plurality of branches;

(b) a plurality of lights disposed on each of said frames, wherein said lights, in combination with each of said frames, forms a snowflake shaped ornament; and (c) at least one controller;

wherein each of said plurality of frames are electrically coupled together using a patterned multi-channel connection so that a set of said plurality of lights on each frame are on the same channel while simultaneously being on a different channel than a set of lights on an adjacent connected frame, wherein said controller alternately turns on and off each channel to turn on and off a plurality of lights disposed within each of said plurality of frames to create a decorative pattern or display to produce an appearance of falling snow.

19. The device as in claim 18 wherein said plurality of branches and sub-branches extend in three dimensions.

20. An ornamental display comprising:

(a) a plurality of snowflake-shaped frames made from a translucent material wherein each frame comprises;

i) a central region i) a plurality of branches coupled to said central region;

ii) a plurality of sub-branches coupled to said plurality of branches; (b) at least one light disposed inside of each of said frames; and (c) at least one controller;

wherein each of said plurality of frames are electrically coupled together using a patterned multi-channel connection so that said at least one light on each frame are on the same channel while simultaneously being on a different channel than a set of lights on an adjacent connected frame, wherein said controller alternately turns on and off each channel to turn on and off said at least one light disposed within each of said plurality of frames to create a decorative pattern or display to produce an appearance of falling snow.

* * * * *